US009402492B2

(12) United States Patent
Babington

(10) Patent No.: US 9,402,492 B2
(45) Date of Patent: Aug. 2, 2016

(54) CONVERTIBLE MAT

(75) Inventor: Duncan John Babington, Devon (GB)

(73) Assignee: Tradestock Limited, Somerset (GB)

( * ) Notice: Subject to any disclaimer, the term of this patent is extended or adjusted under 35 U.S.C. 154(b) by 0 days.

(21) Appl. No.: 13/696,928

(22) PCT Filed: Dec. 8, 2011

(86) PCT No.: PCT/GB2011/001700
§ 371 (c)(1),
(2), (4) Date: May 22, 2013

(87) PCT Pub. No.: WO2012/085494
PCT Pub. Date: Jun. 28, 2012

(65) Prior Publication Data

US 2013/0236690 A1 Sep. 12, 2013

(30) Foreign Application Priority Data

Dec. 21, 2010 (GB) ..... 1021815.4

(51) Int. Cl.
*A47G 23/03* (2006.01)
*B65D 5/36* (2006.01)
*A47G 23/06* (2006.01)

(52) U.S. Cl.
CPC ..... *A47G 23/0303* (2013.01); *A47G 23/06* (2013.01); *B65D 5/3657* (2013.01); *Y10T 428/24273* (2015.01); *Y10T 428/24488* (2015.01)

(58) Field of Classification Search
CPC ..... A46G 23/0303; A46G 23/032; A46G 23/0608; A46G 23/0616; B65D 5/00; B65D 5/3635; B65D 5/3642; B65D 5/3657
See application file for complete search history.

(56) References Cited

U.S. PATENT DOCUMENTS

| | | | | |
|---|---|---|---|---|
| 4,711,797 | A * | 12/1987 | Niske | 428/34.2 |
| 5,211,434 | A | 5/1993 | Lanava | |
| 5,638,978 | A * | 6/1997 | Cadiente | 229/186 |
| 7,597,209 | B2 * | 10/2009 | Rothschild | A45C 7/0036 220/23.87 |
| 2008/0020155 | A1 | 1/2008 | Taatjes et al. | |
| 2010/0133142 | A1 * | 6/2010 | Avery et al. | 206/557 |

FOREIGN PATENT DOCUMENTS

| | | | |
|---|---|---|---|
| CN | 201842325 | U | 5/2011 |
| DE | 202006019364 | U1 | 5/2008 |
| GB | 2234227 | A | 1/1991 |
| GB | 2450948 | A * | 1/2009 |

(Continued)

OTHER PUBLICATIONS

TheFreeDictionary.com, "tray". Farflex, Inc. (2014). <http://www.thefreedictionary.com/p/tray>.*

(Continued)

*Primary Examiner* — David Sample
*Assistant Examiner* — Donald M Flores, Jr.
(74) *Attorney, Agent, or Firm* — Banner & Witcoff, Ltd.

(57) ABSTRACT

A convertible mat (10) is provided and comprises a generally planar base (20) and a border extending around the base, the border comprising border sections (25, 26, 27, 28) joined together by webs, the webs being single, substantially non-folding web sections (35, 36, 37, 38) which cause the border sections to be movable together between a first position in which they are coplanar with the base and a second position in which they are inclined whereby to form a tray.

24 Claims, 12 Drawing Sheets

(56) References Cited

FOREIGN PATENT DOCUMENTS

| | | | |
|---|---|---|---|
| JP | 2002012215 | A | 1/2002 |
| WO | 2006083633 | A2 | 8/2006 |

OTHER PUBLICATIONS

International Search Report dated Mar. 5, 2012.

EP Application 11 808 682.6-1653, Communication pursuant to Article 94(3) EPC, dated Aug. 13, 2015.

* cited by examiner

CONVERTIBLE MAT

CROSS REFERENCE TO RELATED APPLICATIONS

This application is a National Stage application of co-pending PCT application PCT/GB2011/001700 filed 8 Dec., 2011, which claims the benefit of GB application number 0121815.4 filed 21 Dec., 2010. These applications are incorporated herein by reference in their entireties.

The present invention relates generally to a mat and particularly to a convertible mat providing two or more alternative uses.

It is known to provide mats in a variety of situations, for example a piece of fabric or flat material can be placed on a floor or other flat surface and serve a variety of purposes including protecting the underlying surface. For example, a placemat is a protective table pad used in restaurants or households the primary function of which is to protect a table from water marks, food stains or heat damage.

Known mats fulfil a single function, for example receiving a plate or dish whilst positioned on a table. The present invention seeks to provide improvements over such known mat- or pad-like structures.

According to a first aspect of the present invention there is provided a convertible mat comprising a generally planar base and a border extending around the base, the border comprising border sections joined together by webs, the webs being single, substantially non-folding web sections which cause the border sections to be movable together between a first position in which they are coplanar with the base and a second position in which they are inclined whereby to form a tray.

The present invention therefore provides a mat which can have an alternate function as a tray so that it can serve the dual purpose of transporting items or receiving them on a support surface. This allows for the possibility for the mat to be used to both transport items to a support surface and receive them on that surface. Because the mat is convertible between the planar and tray configurations this can be used to facilitate easier loading and use steps. For example, the mat can be converted to the mat-like planar configuration to facilitate loading before conversion to the tray-like configuration for transport and back again to the mat-like configuration on a support surface, for example for unloading or use of the item on the mat.

According to a further aspect of the present invention there is provided a convertible mat comprising the generally planar base and a border extending around at least part of the base, the border being movable from a first position in which it is substantially co-plainer with the base to a second position in which it is inclined to the base whereby to form a tray.

The border may extend from the periphery of the base. Embodiments in which the border projects from a position inboard of the periphery are also contemplated.

The border may extend completely around the base. Accordingly the border may be substantially continuous. Alternatively the border may extend around discrete sections of the base, for example opposite sides, as discrete border sections.

The border may be hingedly connected to the base. For example, the border may be connected and moveable by a series of fold lines which allow folding of the border relative to the base to move between the first and second position.

The border may be formed integrally with the base. In other words, the border may be formed so as to be continuous with the base. In some embodiments, however, the border may be separate from and releasably connectable to the base.

The border may comprise one or more connecting webs to facilitate movements. This may be particularly relevant where the border is required to extend around corners on a base so that flexible connecting webs can be used to connect adjacent rigid border sections.

The border may be movable in either direction with respect to the base plane so that the mat is reversible. This means that, for example, either side of the base could be used to form the face which receives items. This allows for the possibility that the sides of the base could be different, such as different colours or different properties which could be chosen by user depending on a required situation.

The border may include one or more handles. The handles may be used to hold the mat and in doing so retain the mat in the tray configuration. The handles may be formed as openings in the border or, for example, as straps or lops connected to the border.

The base may be substantially rectangular. Other shapes of base are contemplated including square, triangular or other polygons. Irregular as well as regular shapes are contemplated.

The periphery of the border may be generally parallel to the periphery of the base. In other words, the border has the some general outline as the base and the line along which the border extends from the base is generally parallel to the outer periphery of the border.

The mat may be bistable. In other words, the mat and tray positions are stable and the mat will hold itself in those positions, but can be "flipped" between. Alternatively the mat may be biased to one of the end positions.

In some embodiments there may be provided means for holding the mat in the tray configurations. For example, an array of magnets and ferromagnetic materials may be positioned in the corners to temporarily hold border parts together.

The border may include two border sections extending along two shorter sides of a rectangular base, either of both of which may comprise a handle.

The periphery of the border may be generally parallel to the periphery of the base.

At least one of the border sections may be generally trapezoidal.

When present the webs may be generally triangular. Although the webs may be arranged so as not to fold in use, they may be flexible. The webs may be joined to the ends of adjacent border sections by fold lines.

In the second position the plane of the webs may be parallel to the plane of an adjacent border section.

At least one of the border sections may extend beyond the perimeter of the base.

The mat may be made from any suitable material and may comprise, for example, synthetic and/or natural materials including paper, wood, metal, plastics or fabrics. The mat may comprise a covering such as a leather or leatherette covering. The materials from which the mat and any covering is formed can be selected on the basis of the required properties. For example, table placemats may require heat-resistance.

The mat may comprise a place mat. The invention may therefore be formed as a table placemat intended to receive plates dishes and the like so that such items can be transported with the mat in the tray configuration and placed on a table before converting to the mat configuration so that the border does not interfere with subsequent access to the items.

According to a further aspect of the present invention there is provided a convertible mat comprising the generally planar base and a border extending around at least part of the base, the border being movable from a first position in which it is substantially co-plainer with the base to a second position in which it is inclined to the base whereby to form a tray.

Other applications for the present invention are envisaged including, for example, use in the building industry where the mat could be placed on the floor and loaded easily with materials before conversion to a tray configuration for easy transport, or in the DIY industry where a moulded plastics (such as polypropylene) mat could, for example, be used for assembling and moving items.

Further particular and preferred aspects and embodiments of the present invention are set out in the accompanying independent and dependent claims. Features of the dependent claims may be combined with features of the independent claims as appropriate, and in combinations other than those explicitly set out in the claims.

The present invention will now be more particularly described, by way of example, with reference to the accompanied drawings, in which.

Figure 1:
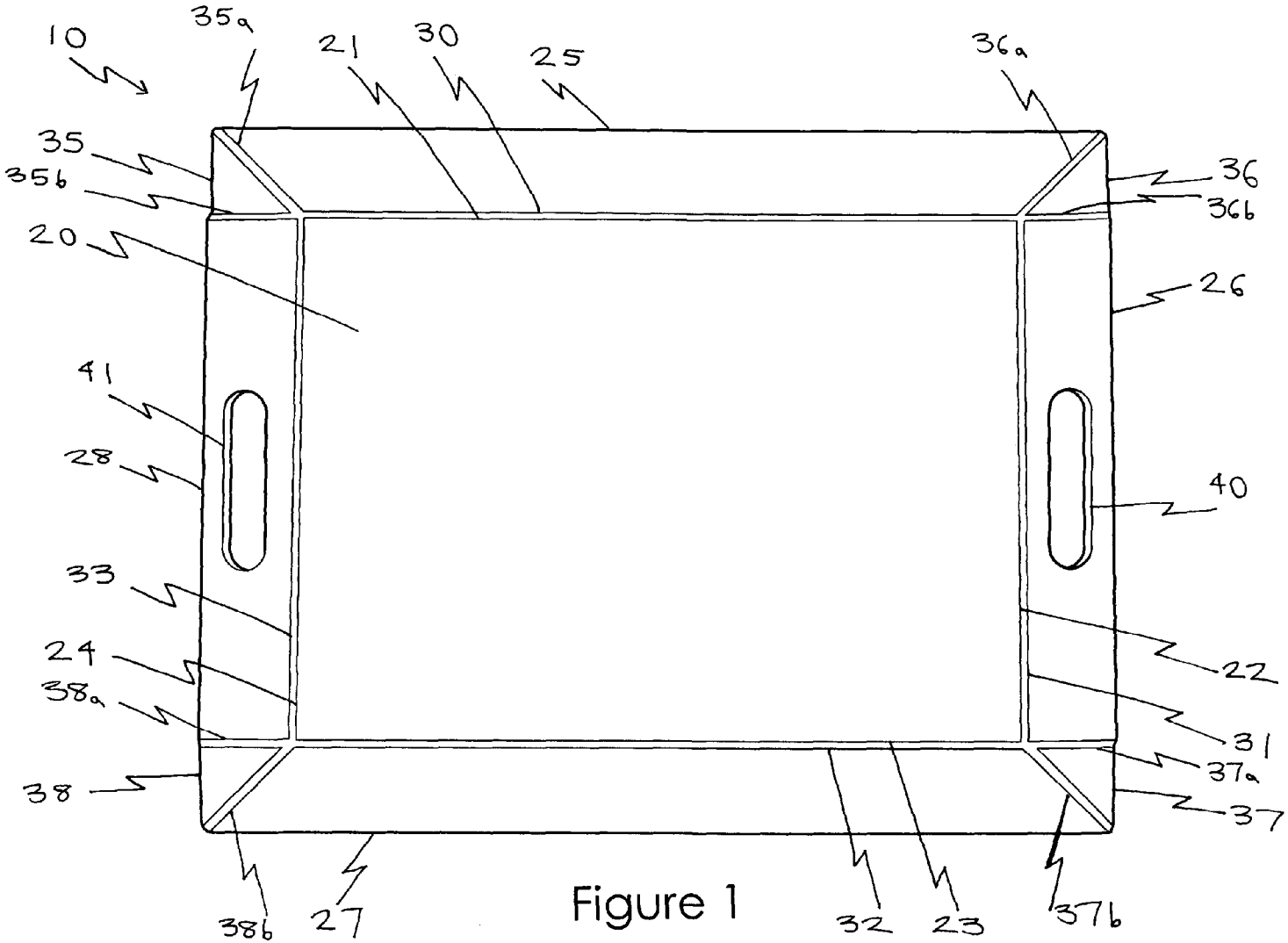
FIG. 1 is a plan view of a mat formed according to the present invention.

Referring first to FIG. 1 there is shown a convertible mat generally indicated 10.

The mat 10 comprises a generally rectangular pad-like base 20 having four sides 21, 22, 23, 24. At the periphery of each side of the base 20 a respective border section 25, 26, 27, 28 extends and is joined to the base side by a respective folding line 30, 31, 32, 33.

The border sections 25, 27 which extend along the longer sides 21, 23 of the base 20 are generally trapezoidal. The border sections 26, 28 extending along the shorter sides 22, 24 of the base 20 are generally rectangular.

The border sections 25, 26, 27, 28 are joined together at the corners of the base by generally triangular connecting webs 35, 36, 37, 38. The webs 35, 36, 37, 38 are joined to the ends of adjacent border sections at respective fold lines 35*a*, 35*b*, 36*a*, 36*b*, 37*a*, 37*b*, 38*a*, 38*b*.

The base 20 and border sections 25, 26, 27, 28 are formed from relatively stiff material. The webs 35, 36, 37, 38 are formed from more flexible material. In this embodiment the base and border sections are formed from stiffened panels and the entire mat is covered in leather. The webs 35, 36, 37, 38 do not include stiffened panels and thus simply comprise leather so as to be flexible.

The border sections 26, 28 each comprise a generally oval cut-out 40, 41 which form handles.

Figure 2:
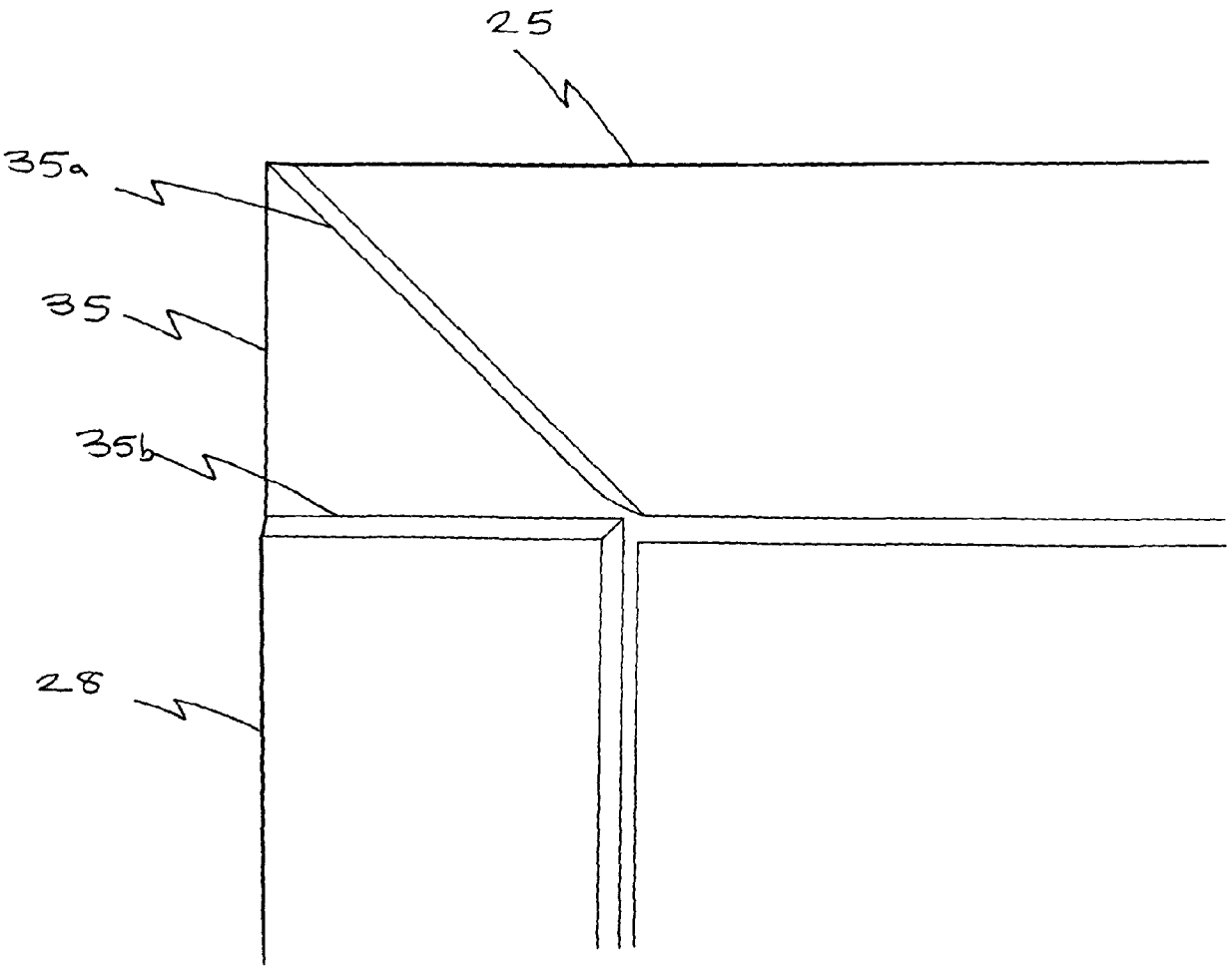
FIG. 2 is a magnified view of one corner of the mat of FIG. 1.

In the configuration shown in FIGS. 1 and 2, the mat 10 is in a generally uniplanar state and would generally adopt this form if placed on a flat surface such as a table of floor. In this configuration it would be easy to load items on to the base 20 for transport and/or use. The mat 10 is moveable to a tray-like configuration now described with respect to FIGS. 3 to 7.

Figure 3:
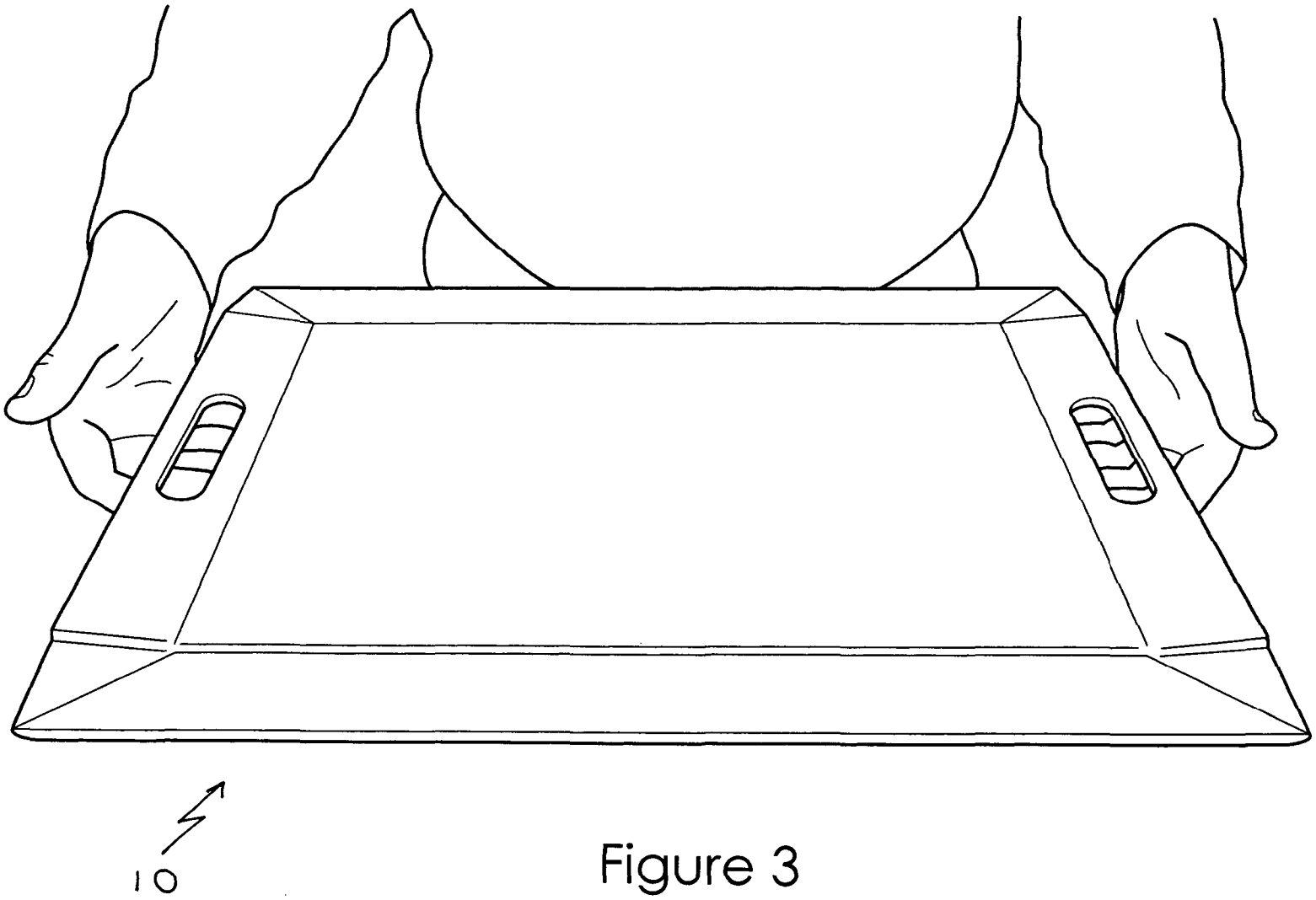
FIG. 3 is a perspective view of the mat leaving a first, flat position.
Figure 4:
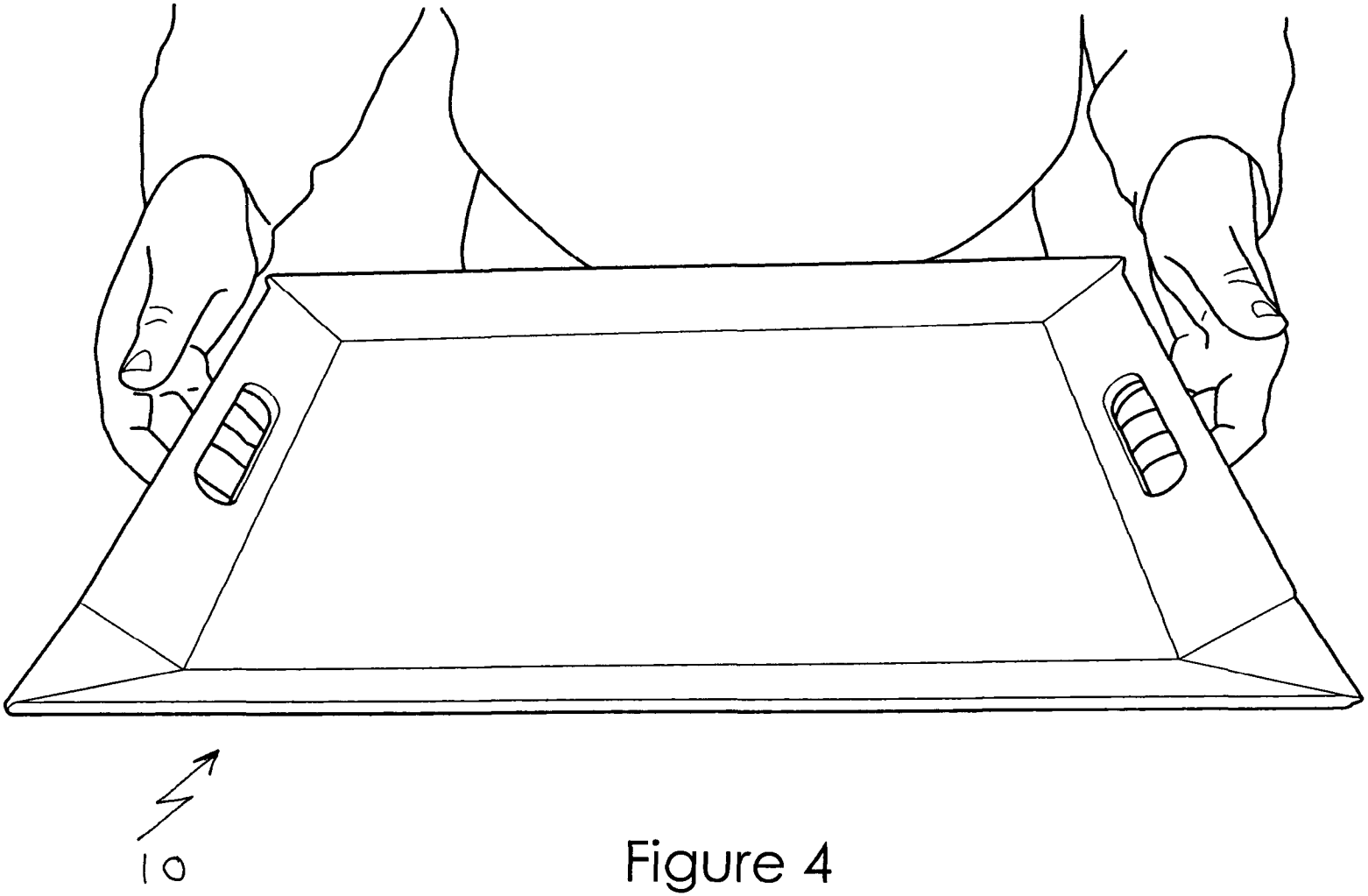
FIG. 4 is a perspective view of the mat shown in an intermediate position.
Figure 5:
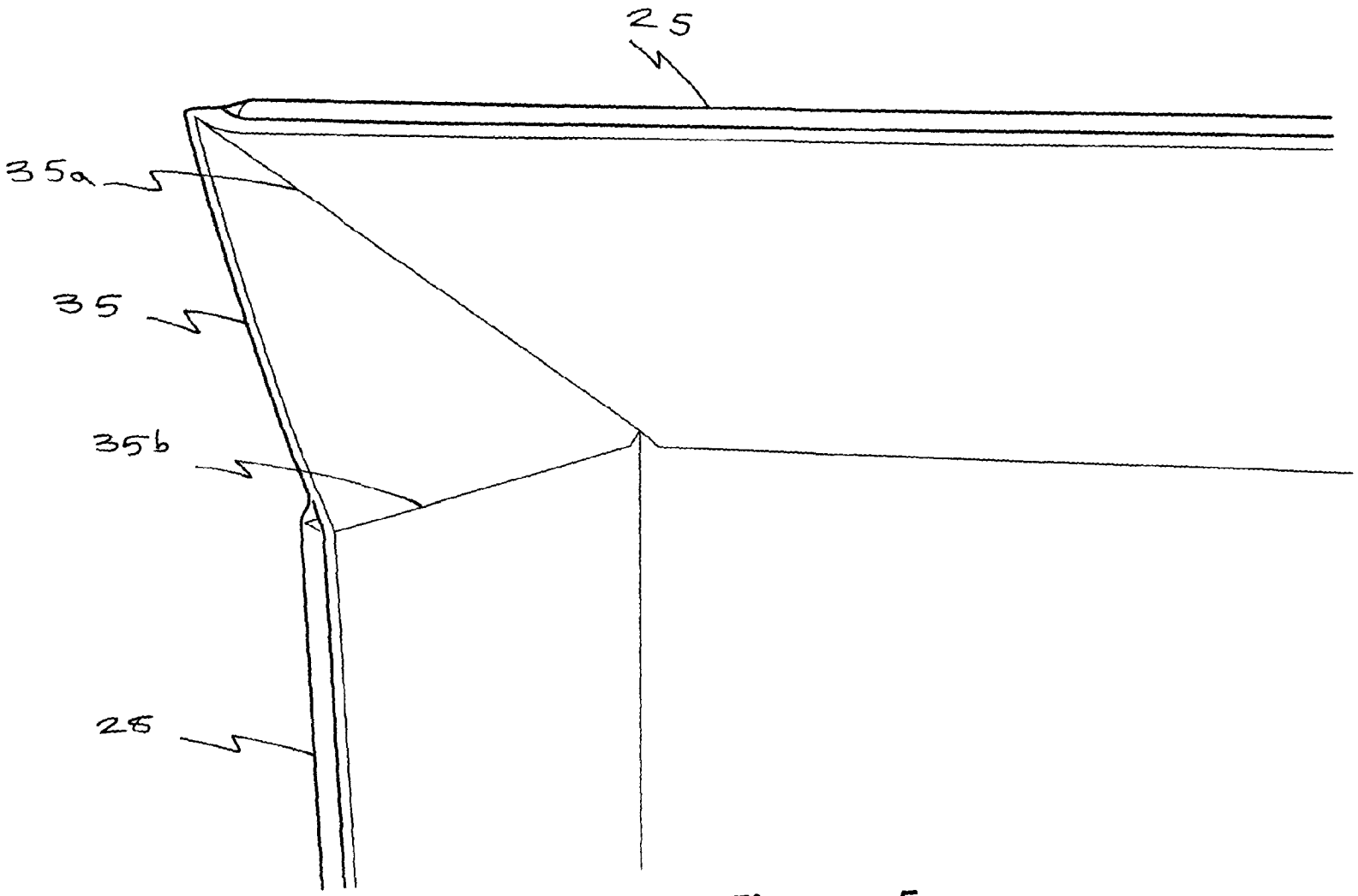
FIG. 5 is a magnified view of one corner of the mat of FIG. 4.
Figure 6:
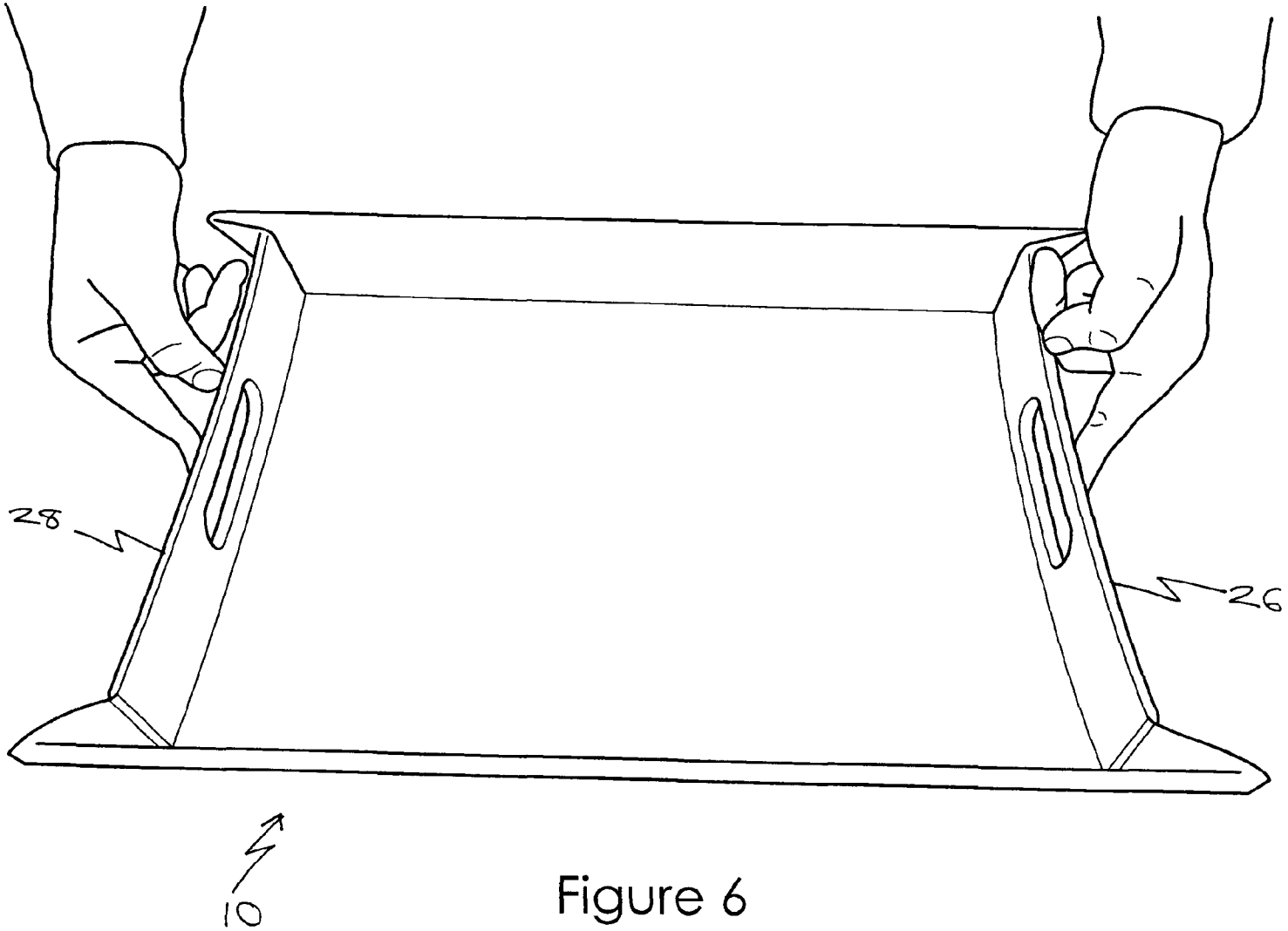
FIG. 6 is a perspective view of the mat shown in a second position.
Figure 7:
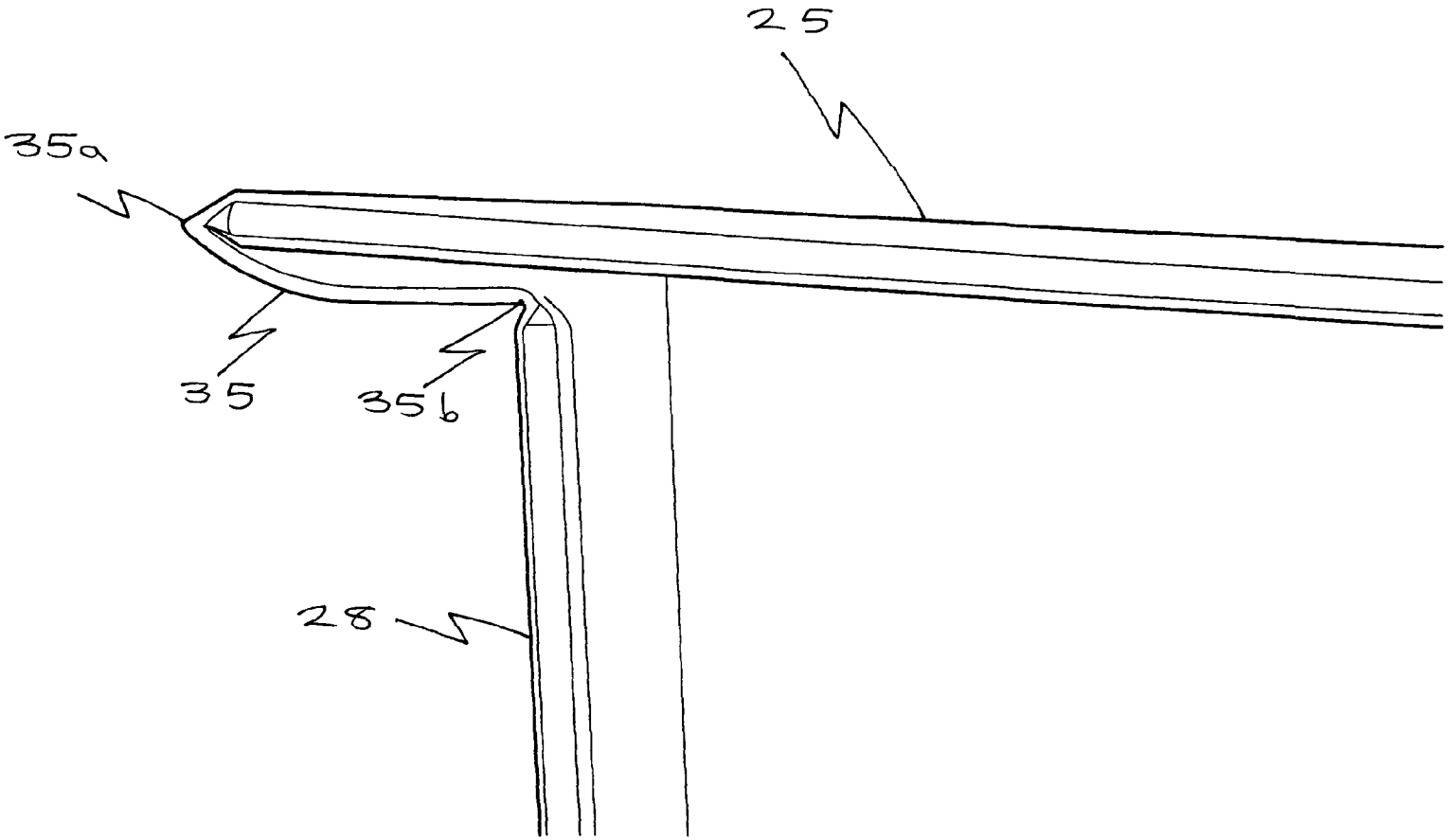
FIG. 7 is a magnified view of one corner of the mat FIG. 6.

As shown in FIG. 3, a user can place their hands under the border sections 26, 28 and begin raising them as shown in FIG. 6. Because the sections 26, 28 are joined to the sections 25, 27 by the webs 35, 36, 37,38 this also causes the sections 25, 27 to begin to fold upwards. Each of the sections 25, 26, 27, 28 folds along the respective fold lines 21, 22, 23, 24 and folding also occurs along the connecting web fold lines as shown in FIG. 5. It will be noted that, although they cause the folding, the web themselves are not folded, with folding occurring at the peripheral fold lines.

In FIG. 6 the mat 10 is shown in the second end position in which all of the border sections 25, 26, 27, 28 are folded upwards and inwards. In this configuration a user can hold the mat turn by the handles 40, 41, which keeps the mat in the tray-like configuration and allows for items to be readily transported.

Figure 8:
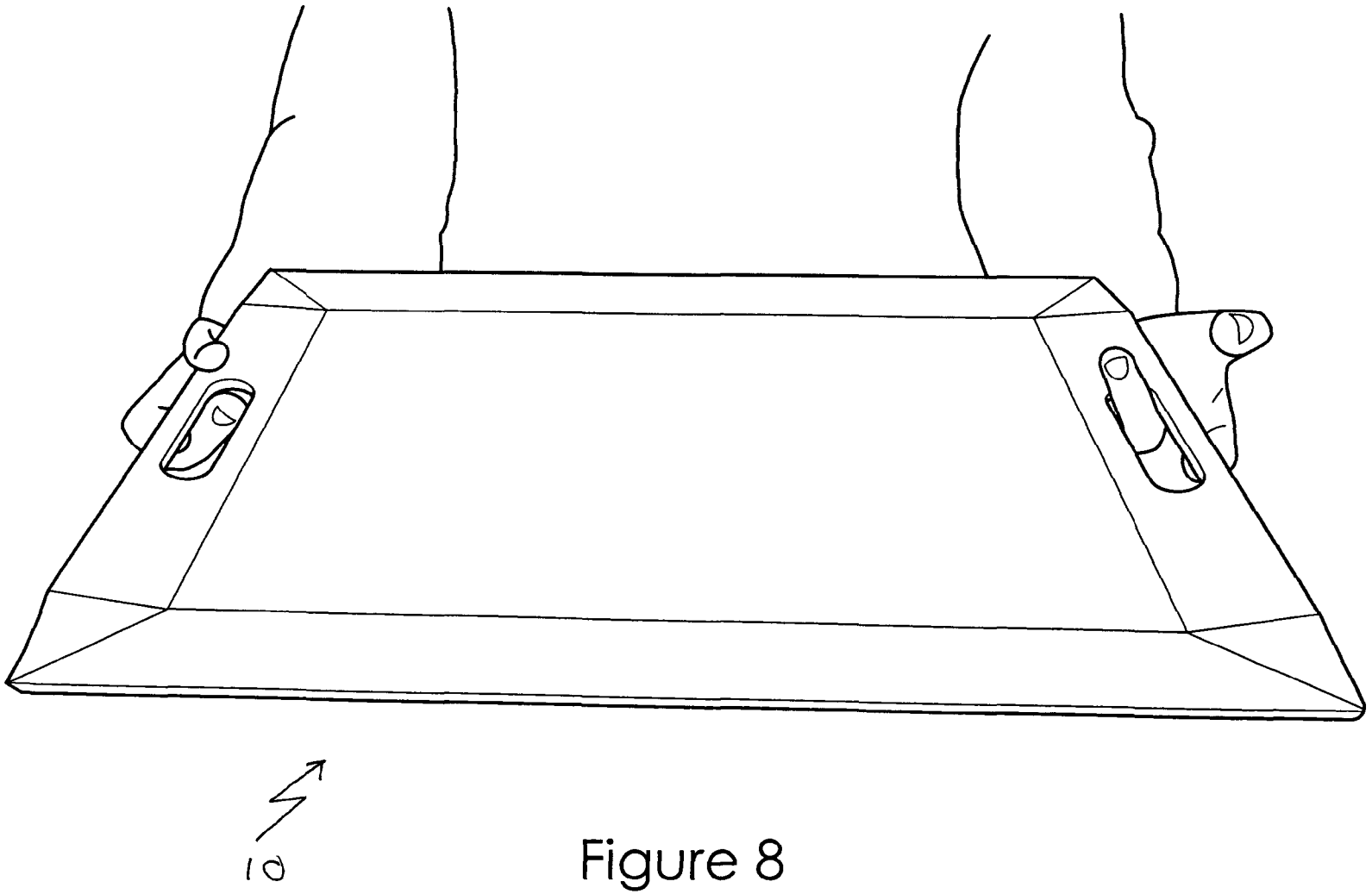
FIG. 8 is a perspective view of the mat of FIG. 6 shown being unfolded towards the flat position.
Figure 9:
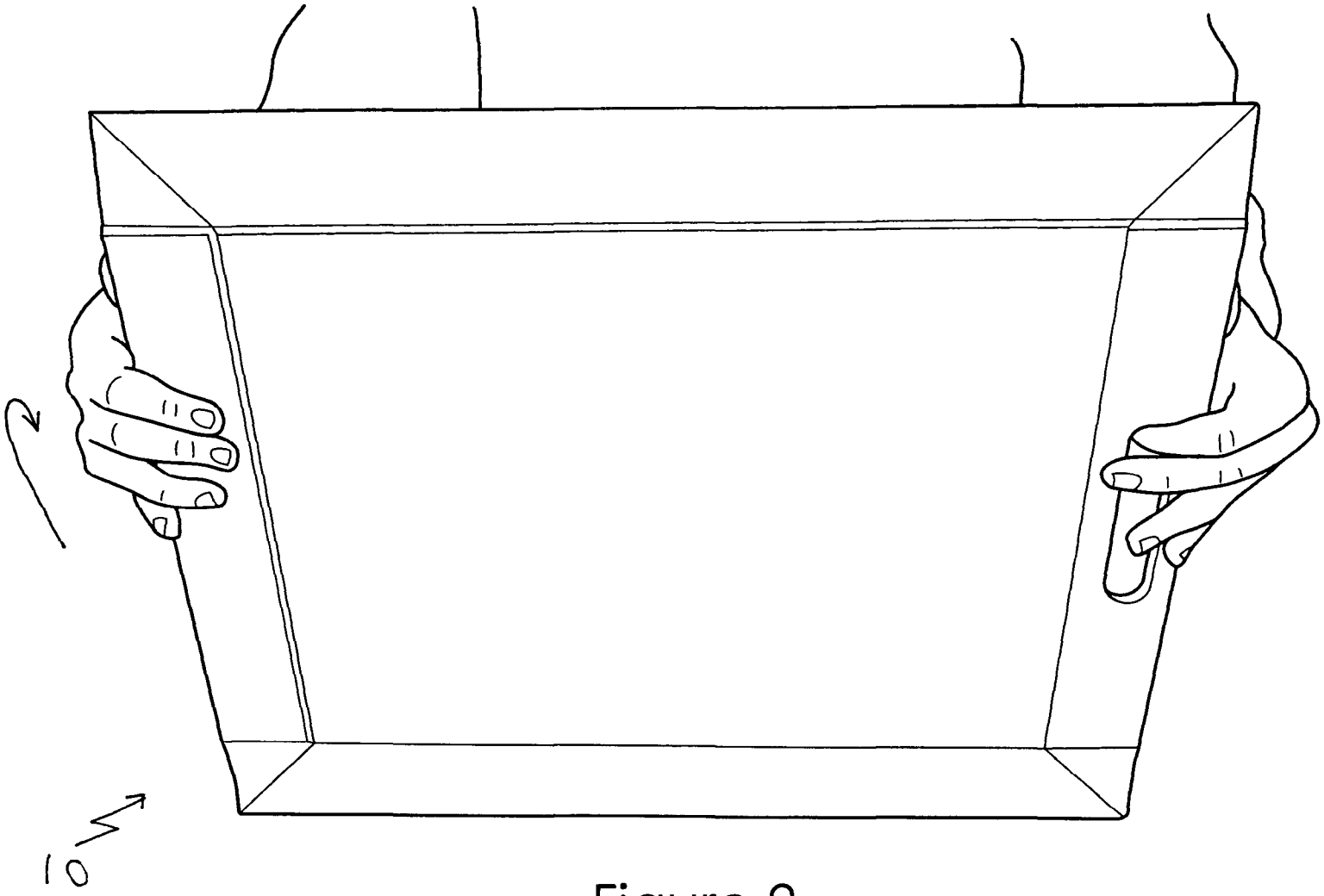
FIG. 9 is a perspective view of the mat shown as it is being rotated 180°.
Figure 10:
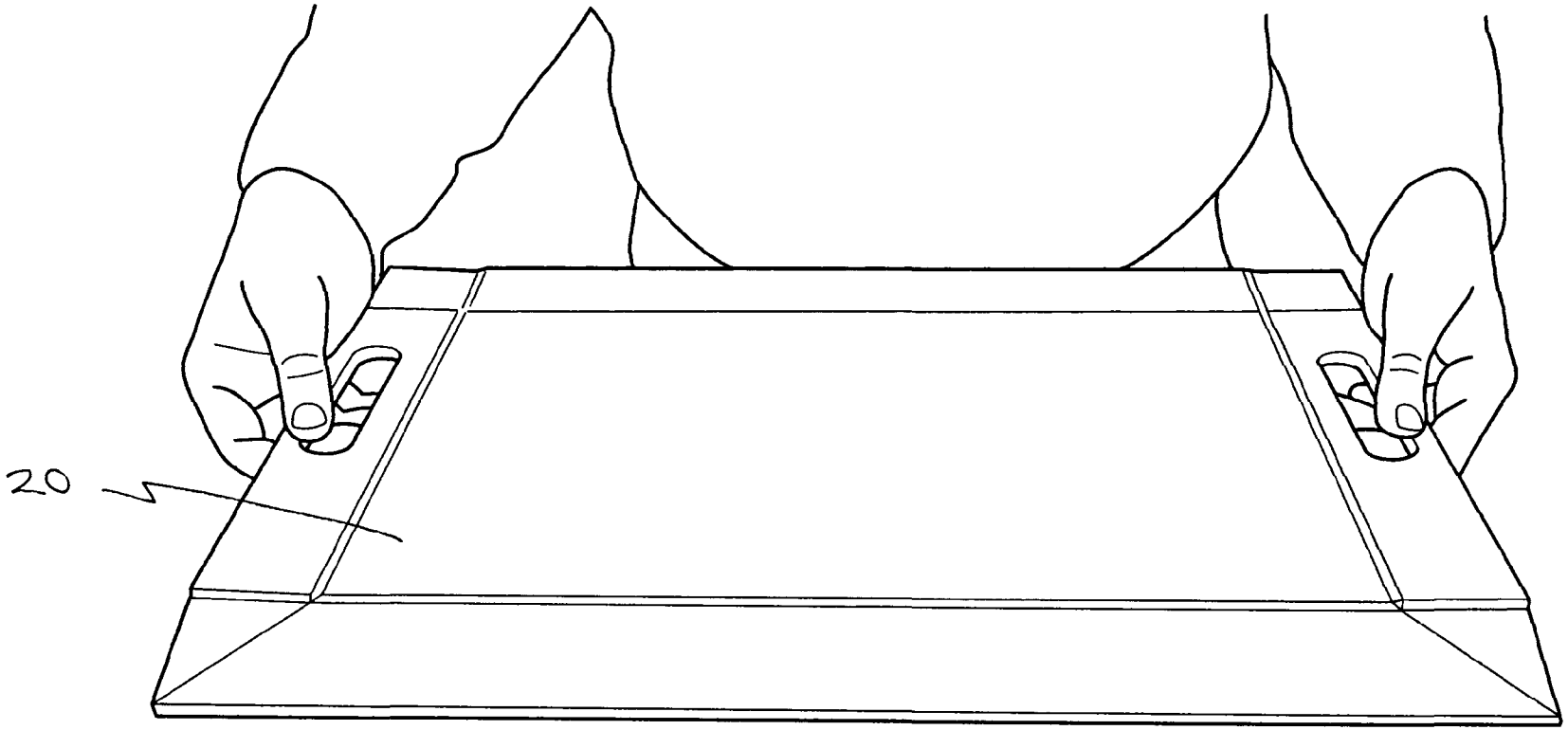
FIG. 10 is a perspective view of the mat of FIG. 9 shown following complete reversal.
Figure 11:
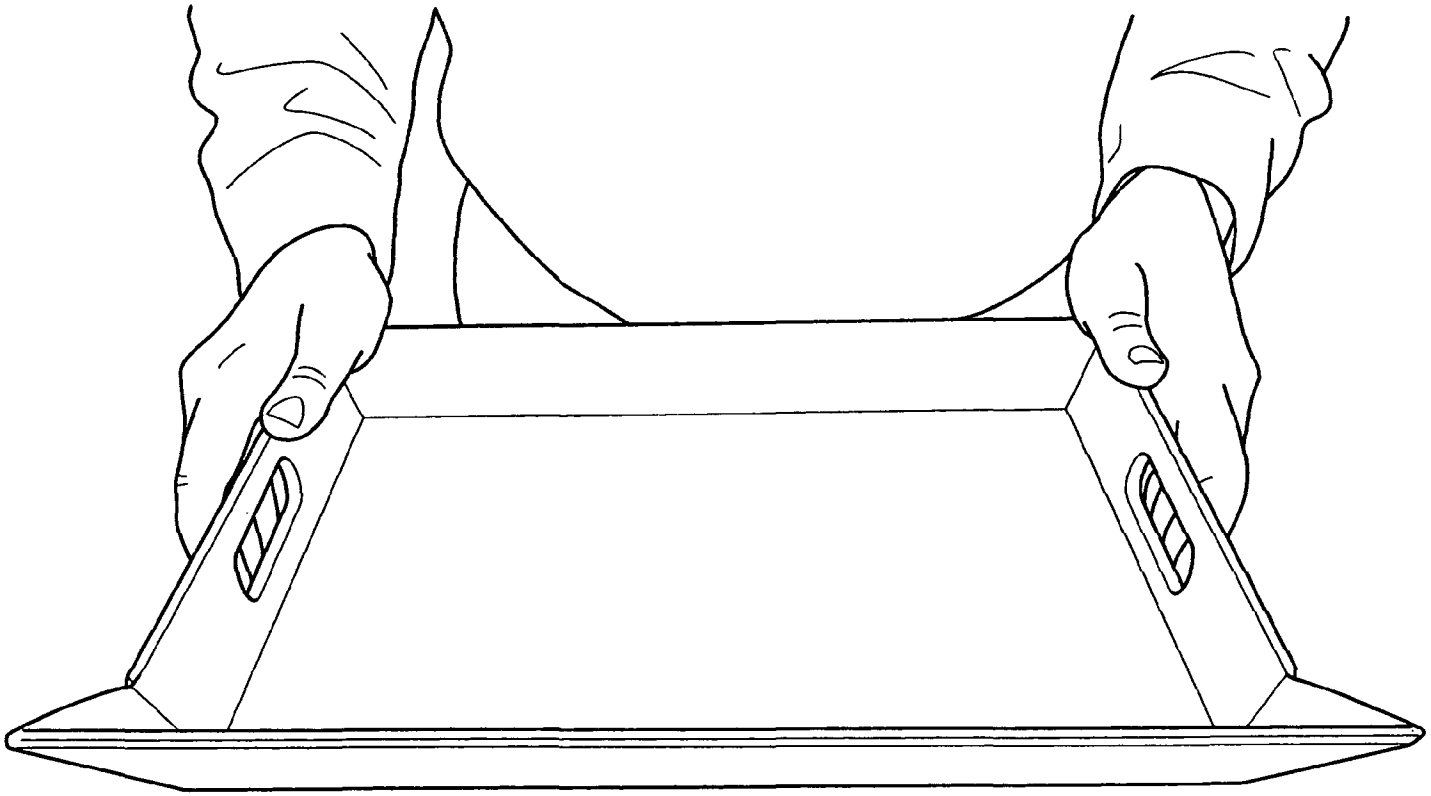
FIG. 11 is a perspective view of the mat of FIG. 10 shown in a second position.
Figure 12:
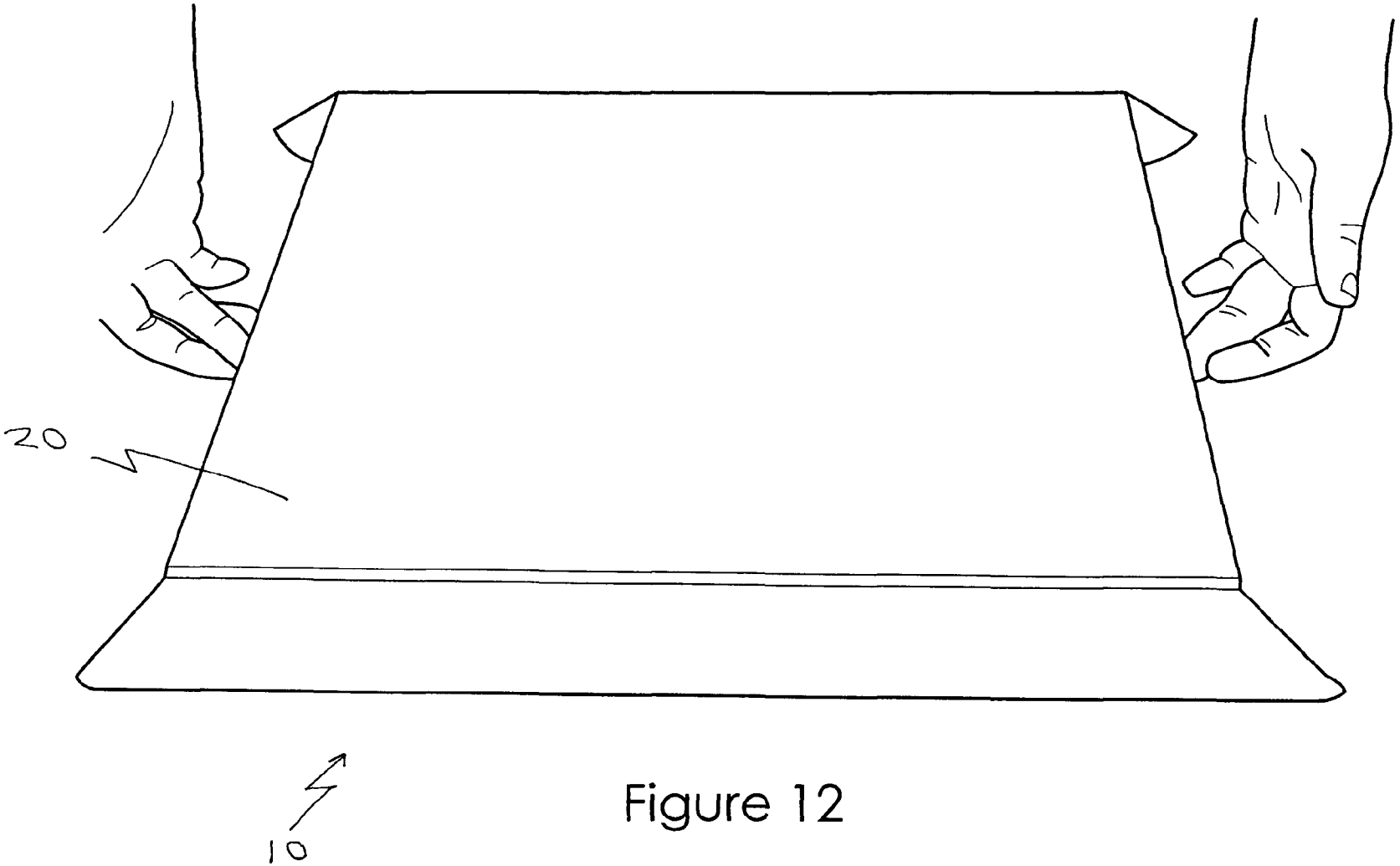
FIG. 12 is a perspective view of the mat of FIG. 11 shown with its border flipped in the opposite direction.

In this embodiment all of the fold lines are constructed so that the respective borders and connecting webs can be folder in either direction. Accordingly, the mat can be moved from the tray-like configuration of FIG. 6 back down to the flat configuration shown in FIG. 8 by pulling down the border sections 26, 28. Subsequently, the mat can be flipped 180° as shown in FIG. 9 so that the opposite face of the base 20 is exposed as shown in FIG. 10. The border sections 26, 28 can then be folded the other way to move the mat 10 back to a tray-like configuration as shown in FIG. 11. This means that the face of the base 20 which formed the top side in FIG. 6 now forms the underside as shown in FIG. 12.

In this embodiment the mat 10 is represented as a place mat, but in other embodiments the sample principals could be employed to provide larger or smaller mats and with different materials for different purposes.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

The invention claimed is:

1. A convertible mat comprising a planar base and a border extending around the base, the border comprising border sections, the border sections joined together by webs, the webs being single, non-folding web sections joined to the ends of adjacent border sections by respective fold lines located at the ends of the adjacent border sections, which cause the border sections to be movable together between:

a first position in which they are coplanar with the base, and a second position in which they are inclined relative to the base whereby to form a tray, wherein the web sections are thinner than the base and border sections, the thickness of the web sections along the respective fold lines at the ends of the adjacent border sections is thinner than the thickness of the ends of the adjacent border sections along the respective fold lines at the ends of the adjacent border sections, and the border sections are repeatably movable between said first position and said second position.

2. A convertible mat as claimed in claim 1, in which the border extends from the periphery of the base.

3. A convertible mat as claimed in claim 1, in which the border is hingedly connected to the base.

4. A convertible mat as claimed in claim 1, in which the border sections are joined to the side of the base by respective fold lines located at the side of the base, and the border is movable by folding.

5. A convertible mat as claimed in claim 1, in which the border is formed integrally with the base.

6. A convertible mat as claimed in claim 1, in which the border is moveable in either direction with respect to the base plane such that the mat is reversible.

7. A convertible mat as claimed in claim 1, in which the border includes one or more handles.

8. A convertible mat as claimed in claim 7, in which each handle is formed as an opening in the border.

9. A convertible mat as claimed in claim 1, in which the base is rigid.

10. A convertible mat as claimed in claim 1, in which the border sections are rigid.

11. A convertible mat as claimed in claim 1, in which the convertible mat comprises a covering.

12. A convertible mat as claimed in claim 11, in which the covering comprises leather or leatherette.

13. A convertible mat as claimed in claim 1 in which the base is rectangular.

14. A convertible mat as claimed in claim 13, in which the border includes two border sections extending along the two shorter sides of the base, each having a handle.

15. A convertible mat as claimed in claim 1, in which the periphery of the border is parallel to the periphery of the base.

16. A convertible mat as claimed in claim 1, in which at least one of the border sections is trapezoidal.

17. A convertible mat as claimed in claim 1, in which the webs are triangular.

18. A convertible mat as claimed in claim 1, in which the webs are flexible.

19. A convertible mat as claimed in claim 1, in which in the second position the plane of the webs is parallel to the plane of an adjacent border section.

20. A convertible mat as claimed in claim 1, in which at least one of the border sections extends beyond the perimeter of the base.

21. A convertible mat as claimed in claim 1, in which the convertible mat comprises a placemat.

22. A convertible mat as claimed in claim 1, in which the convertible mat comprises a building industry or DIY transport mat.

23. A convertible mat comprising a planar base and a border extending around the base, the border comprising border sections, the border sections joined together by webs, the webs being single, non-folding web sections joined to the ends of adjacent border sections by respective fold lines located at the ends of the adjacent border sections, which cause the border sections to be movable together between:

a first position in which they are coplanar with the base, and a second position in which they are inclined relative to the base whereby to form a tray;

wherein the web sections are thinner and more flexible than the base and border sections; and wherein the border sections are repeatably movable between said first position and said second position.

24. A convertible mat as claimed in claim 23, in which the convertible mat is provided with means for temporarily holding the border sections in the second position.

* * * * *